United States Patent [19]

Kashima et al.

[11] 4,342,885

[45] Aug. 3, 1982

[54] LIMIT SWITCH

[75] Inventors: Isoo Kashima; Yosio Takase; Masami Mishina, all of Kadoma, Japan

[73] Assignee: Matsushita Electric Works, Ltd., Osaka, Japan

[21] Appl. No.: 208,424

[22] Filed: Nov. 19, 1980

[30] Foreign Application Priority Data

Mar. 27, 1980 [JP] Japan ..... 55-38208

[51] Int. Cl.[3] ..... H01H 3/16; H01H 5/06

[52] U.S. Cl. ..... 200/47; 200/67 B; 200/153 V; 200/293; 200/340

[58] Field of Search ..... 200/47, 67 B, 67 R, 200/153 T, 153 V, 159 A, 330, 340, 296, 293

[56] References Cited

U.S. PATENT DOCUMENTS

| | | | |
|---|---|---|---|
| 2,431,747 | 12/1947 | Fry | 200/47 |
| 2,566,824 | 9/1951 | Carlson | 200/47 |
| 3,427,420 | 2/1969 | Geremia et al. | 200/330 |
| 3,432,632 | 3/1969 | Schenke | 200/67 B |
| 3,763,339 | 10/1973 | Holmes | 200/67 B |

FOREIGN PATENT DOCUMENTS

| | | | |
|---|---|---|---|
| 1160921 | 1/1964 | Fed. Rep. of Germany | 200/330 |
| 639036 | 12/1978 | U.S.S.R. | 200/47 |

*Primary Examiner*—John W. Shepperd

*Attorney, Agent, or Firm*—Burns, Doane, Swecker & Mathis

[57] ABSTRACT

A limit switch wherein a switch mechanism and plunger for operating the mechanism are assembled together to a switch body having pull-out terminals to form an integral switch assembly which is housed in a housing from its open bottom inserting the plunger through a guide cylinder on the top of the housing. The plunger biased normally outward is operably coupled through an actuator to a movable contactor against a contactor turning spring force biasing the actuator normally inward. The switch assembly is fixed to the housing with the plunger retreated inward by a predetermined amount where the contactor is once turned over, the amount thus determining a retreating stroke of the plunger for the mechanism operation through the actuator to turn over the movable contactor.

10 Claims, 6 Drawing Figures

LIMIT SWITCH

This invention relates generally to limit switches and, more particularly, to improvements in limit switches wherein operating position of actuating plunger for electric switch mechanism is adjustable.

In a typical one of conventional limit switches of the kind referred to, as shown in FIGS. 1 and 2, a switch assembly 2 is fitted within a housing 1, a push button 4 of the assembly 2 is provided so as to be depressed to actuate the switch assembly by the inner end of a plunger 3 held through the housing 1 to be retractable as normally biased to its outward projected position, and an adjusting screw 5 is screwed axially into the inner end of the plunger 3 so that the length of the plunger with which it engages at the inner end with the push button 4 for operating the button as well as switching mechanism in the assembly 2 when the plunger 3 is caused by an external force to be moved into the inward retracted position, can be properly adjusted by screwing the screw 5 inward or outward to vary the length.

That is, the conventional limit switches of the kind referred to must be provided with a special means separate from the switch assembly 2 as well as the plunger 3 and housing 1 for properly adjusting the operating position of the plunger with respect to the switch assembly. In assembling such switch, therefore, the switch assembly 2 is first fitted in the housing 1 and thereafter relative position of the plunger 3 to the push button 4 of the assembly is to be adjusted by the adjusting means. In performing such adjustment specifically in this formation of FIGS. 1 and 2, however, the adjusting screw 5 must be operated in a narrow space within the housing 1 so as to render the adjusting work complicated and, in addition, the adjusting screw 5 is likely to loosen so that an accurate operative position of the plunger relative to the push button cannot be achieved stably. The present invention has been suggested to eliminate these defects of the conventional limit switches.

A primary object of the present invention is, therefore, to provide a limit switch wherein the operative plunger position can be accurately and easily set at the time of assembling and is thus high in the workability.

Another object of the present invention is to provide a limit switch wherein the operative plunger position can be set at a high precision with a compact formation without requiring such separate adjusting means as adjusting screw or the like and the operative plunger position once set can be stably maintained.

Still another object of the present invention is to provide a limit switch wherein the operative plunger position can be adjusted in a single motion without requiring such repetitive motions as required in the case of rotating the position adjusting screw.

Other objects and advantages of the present invention shall be made clear as the following description of the invention advances as detailed with reference to a preferred embodiment shown in accompanying drawings, in which.

While the present invention shall be explained in the followings with reference to the illustrated embodiment, the intention is not to limit the present invention only to the particular embodiment but is to rather include all modifications, alterations and equivalent arrangements possible within the scope of appended claims.

Figure 1:
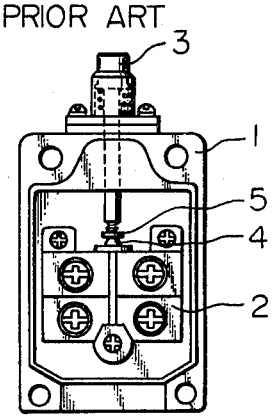
Fig. 1 PRIOR ART
FIG. 1 is an elevation of a conventional limit switch with a cover removed.
Figure 2:
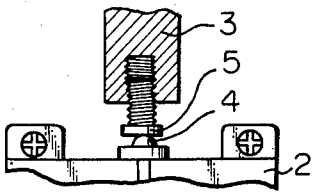
Fig. 2 PRIOR ART
FIG. 2 is a fragmentary magnified view of the switch of FIG. 1 with a plunger in section for showing a state in which an operative plunger position adjusting screw is mounted to the plunger for engagement with a push button of a switch assembly.
Figure 3:
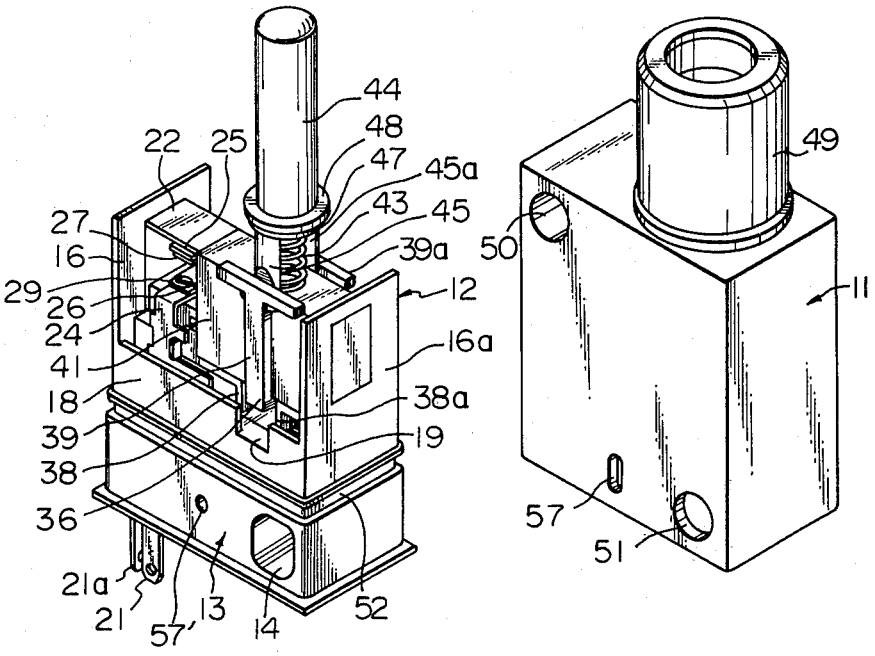
FIG. 3 is a perspective view showing in an enlarged scale a housing and switch assembly of a limit switch in a preferred embodiment of the present invention as disassembled from each other.
Figure 4:
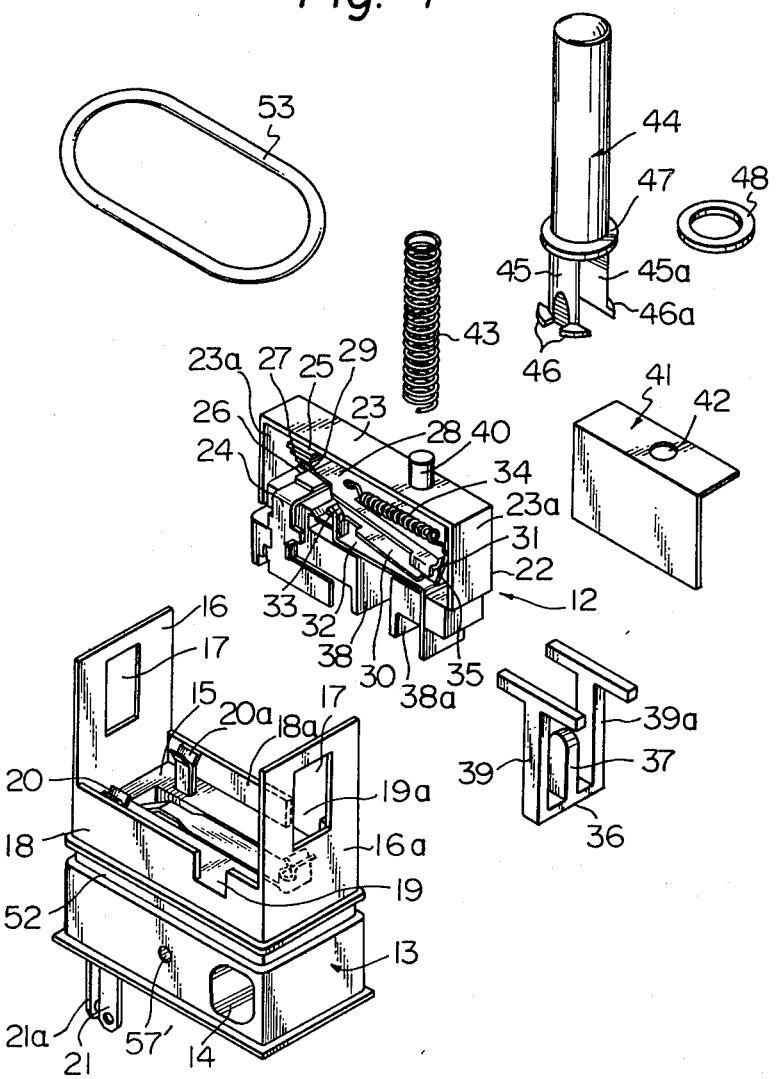
FIG. 4 is a perspective view as disassembled of respective components of the switch of FIG. 3.
Figure 5:
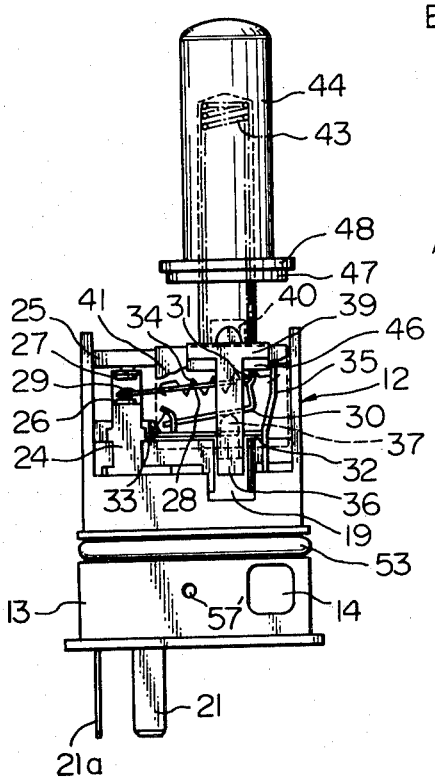
FIG. 5 is an elevation of the switch assembly of FIGS. 3 and 4 in a state before being assembled with the housing where switch contacts of the assembly are in non-switched position.

Referring now to FIGS. 3 to 5 showing a limit switch of the present invention, a housing 11 of the switch is generally hollow and opened at the bottom, and a switch assembly 12 to be housed in the housing 11 generally comprises a switch body 13 which has a fixing hole 14 elliptic or substantially rectangular in section and made in a corner at the lower portion and a switch mechanism accommodating chamber 15 in the upper portion as defined by a pair of parallelly opposing end walls 16 and **16*a* extended upright from the lower portion. These end walls 16 and 16*a* are provided respectively with a rectangular aperture 17 so as to be in alignment with each other. Respective base parts of these end walls 16 and 16*a* are connected by side walls 18 and 18*a*, and incisions 19 and 19*a* are made in the side walls 18 and 18*a* at mutually opposing positions adjacent one of the end walls 16 and 16*a*. A plurality of electric connectors 20 and 20*a* are provided on the lower portion of the body 13 to extend in the accommodating chamber 15, and these connectors 20 and 20*a* are respectively integrally connected electrically to corresponding pull-out terminals 21 and 21*a* extended downward through the lower portion of the switch body 13**.

There is mounted on the switch body 13 an internal switch mechanism 22 which forms a casing together with a substantially rectangular frame 23. The lower portion of this frame 23 is housed in the accommodating chamber 15 of the switch body 13 and is fixed therein with expanded portions **23*a* at upper part of both end surfaces respectively fitted in each of the apertures 17 and 17*a* of the end walls 16 and 16*a*. Within the frame 23, fixed contactors 24 and 25 are held so that fixed contacts 26 and 27 secured on the fixed contactors 24 and 25 will oppose each other through a space, and a movable contactor 28 is disposed so as to position in the space a movable contact 29 secured at a tip end of the contactor 28 movably between the fixed contacts 26 and 27, while the other base end of the movable contactor 28 is pivotably held by a holding arm 31 formed at an end of a substantially L-shaped turning plate 30 which in turn is rockably engaged at the other end to a hook 33 formed on a branched arm of a common terminal plate 32 fixed in the frame 23. A turning spring 34 is engaged at one end with the movable contactor 28 at its position adjacent the movable contact 29 and at the other end with the other extended arm 35 of the common terminal plate 32 as seen best in FIG. 5. The movable contactor 28 and turning plate 30 are formed of a conductive material so as to pass an electric current between either of the fixed contactors 25 and 26 and the common terminal plate 32 which are extended over the bottom of the frame 23 to be connectable with the respective connectors 20 and 20***a* of the accommodating chamber 15 when the switch mechanism 22 is mounted onto the switch body 13.

While not shown, the common terminal plate 32 is provided with an aperture in the branched arm having the hook 33 for passing therethrough a middle push rod 37 of a substantially E-shaped actuator 36 which is brought into engagement with the turning spring plate 30 so as to displace the plate 30 between its normal position and turned position. The frame 23 has an open channel in the bottom, at both end edges of which there are provided downward extended guide legs 38 and 38*a* opposing each other, whereas respective outer legs on both sides of the middle push rod 37 of the actuator 36 are forming a pair of T-shaped guide legs 39 and 39*a* having laterally parallelly extended end arms, and the actuator 36 is mounted to the frame 23 so as to position the upper part of the frame 23 between the end arms of the guide legs 39 and 39*a* while connecting part having the rod 37 of the actuator 36 is positioned in the open channel of the frame 23 to be slidable therein as guided by the legs 38 and 38*a*. The frame 23 has on the top an upward projection 40 at a position disposed between the lateral end arms of the actuator 36, and an L-shaped insulative cover plate 41 having a hole 42 is fitted over the frame 23, engaging the projection 40 in the hole 42, whereas a push-up spring 43 is engaged at its lower end over the projection 40. In addition, a plunger 44 is mounted on the frame 23 so as to house therein the push-up spring 43, and a pair of legs 45 and 45*a* are provided at the lower end of this plunger 44 so as to be positioned on both sides of the frame 23 as extended downward from the plunger 44. A pair of small lateral projections 46 or 46*a* adapted to loosely hold between them each of the guide legs 39 or 39*a* of the actuator 36 are formed at the lower end of the respective legs 45 and 45*a* of the plunger 44, and these pairs of projections 46 and 46*a* are provided engageably with the respective neck parts of the T-shaped guide legs 39 and 39*a*. A peripheral flange 47 is provided around the plunger 44 at the base of the legs 45 and 45*a*, and an elastic ring 48 is fitted on the plunger 44 to rest on this flange 47.

Further, the housing 11 is provided with a guide cylinder 49 formed to project above so that the plunger 44 of the switch assembly 12 can be inserted therethrough, and a step properly engaging with the flange 47 of the plunger 44 is formed within the guide cylinder 49. In an upper corner of the housing 11, further, a fixing hole 50 is formed and, in a lower corner, another fixing hole 51 to be aligned with the fixing hole 14 of the switch assembly 12 is provided. It is preferable that a sealing ring 53 is fitted in a groove 52 formed substantially in the middle of the switch body 13 in order to keep the coupling between the housing 11 and the switch assembly 12 liquid-tight when the latter is housed in the former. The groove 52 may be omitted so that the sealing ring only will be fitted between the housing 11 and the assembly 12 so as to achieve the same liquid-tightness.

Now, the operation of the limit switch according to the present invention and the adjustment of its operating position shall be described in detail with reference to FIG. 5 showing a state of the switch assembly before being assembled in the housing. In this state, the plunger 44 is pushed up or outward by the spring force of the push-up spring 43 and the lateral projections 46 and 46*a* of the respective legs 45 and 45*a* at the lower end of the plunger 44 are engaged respectively with the guide legs 39 and 39*a* of the actuator 36, so that the actuator 36 will be disposed in its outermost projected or uppermost elevated position. In this position of the actuator 36, its push rod 37 projects upward through the common terminal plate 32 so as to push the turning spring plate 30 upward. Therefore, the movable contactor 28 engaged at its base end with the holding arm 31 of the turning spring plate 30 is thrown into its upper position of the base end, whereby the contactor 28 is caused to be subjected to the spring force of the turning spring 34 so as to be displaced at the tip toward the lower fixed contactor 24 and the movable contact 29 and lower fixed contact 26 are closed. In this case, an electric circuit will be formed of the pull-out terminal 21*a* including its connector, common terminal plate 32, turning spring plate 30, movable contactor 28, movable contact 29, fixed contact 26, fixed contactor 24, connector 20 and pull-out terminal 21 corresponding to the fixed contactor 24.

Figure 6:
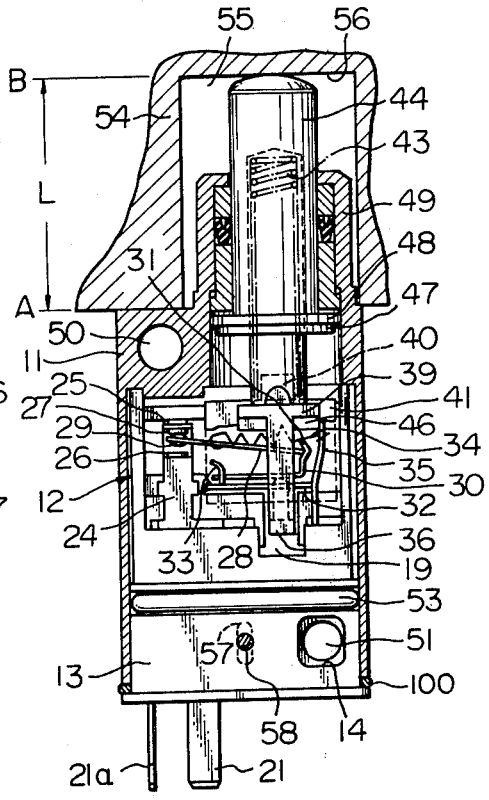
FIG. 6 is sectioned elevation of the switch according to the present invention showing a state in which the switch assembly is assembled with the housing and the switch contacts are switched over.

Further in the limit switch according to the present invention, its operating position can be adjusted at the time of incorporating the switch assembly 12 in the housing 11. Referring in detail to this with reference to FIG. 6, the housing 11 is first brought into engagement with an operating position setting jig 54 before the switch assembly 12 is incorporated into the housing 11 and, at this time, the guide cylinder 49 is positioned in a recess 55 of the setting jig 54. Then the switch assembly 12 is gradually pushed into the housing 11 from the opened bottom of the housing 11 while inserting the plunger 44 through the guide cylinder 49. When the tip end of the plunger 44 engages the innermost wall surface 56 in the recess 55, that is, an projecting amount of the plunger 44 from the guide cylinder 49 reaches a predetermined setting value shown by a distance L between respective reference planes A and B of the jig 54 while the assembly 22 is being pushed into the housing 11, the plunger 44 is pushed inward by the wall surface 56 resisting against the upward biasing force of the spring 43 and the legs 45 and 45*a* also move downward in the drawing, whereby the guide legs 39 and 39*a* of the actuator 36 are released from the upward biasing force of the spring 43 incurred through the lateral projections 46 and 46*a* of the legs 45 and 45*a*. Accordingly, the actuator 36 becomes movable downward between the guide legs 38 and 38*a* of the frame 23 and toward the incisions 19 and 19*a* in the side walls of the accommodating chamber 15 of the body 13 so that, under the spring force of the turning spring 34, the turning spring plate 30 and movable contactor 28 will turn down at their base ends and the tip end carrying the movable contact 29 of the movable contactor 28 will be turned upward to be displaced toward the upper fixed contactor 25, thereby the movable contact 29 is caused to contact the upper fixed contact 27. In other words, the switch assembly 12 is inserted into the housing 11 until the turning motion of the movable contactor 28 is caused upon a certain retreating stroke of the plunger 44 determined by the set value L of the jig 54. In this position of the plunger 44, the switch assembly 12 is stopped inside the housing 11 and the housing 11 and assembly 12 are fixed to each other.

This fixation is performed preferably between the housing 11 and the switch body 13. For this purpose, the housing 11 and body 13 may be provided respectively with a slot 57 and hole 57' so as to render fastening position with respect to the housing of a pin or screw 58 urged into the hole 57' to be adjustable in the slot 57 or, when the switch body 13 is formed of a thermoplastic resin, only the housing 11 may be provided with a hole so that a heated pin will be urged through this hole of the housing into the thermoplastic switch body 13 at its position corresponding to the hole at the foregoing fixing position. When the housing 11 and switch body 13 are both made of a metal, further, they may be fixed by welding 100 or the like in the fixing position performed preferably for joining, for example, between the open end edge of the housing and side walls adjacent the bottom of the body, or even by performing a punching from outside the housing over the base portion of the switch body 13. In these connections, it will be seen in FIG. 6 that in the fixing position of the housing 11 and switch body 13 there is still remained an adjusting allowance in the form of a clearance between the open end edge of the housing 11 and the bottom end of the switch body 13 separated from each other. Further, in the state of FIG. 6, the resilient ring 48 on the flange 47 of the plunger 44 is separated from the step in the guide cylinder 49 of the housing 11.

Thus incorporated assembly of the housing 11 and switch assembly 12 is thereafter removed from the setting jig 54. Then, due to the upward biasing force of the push-up spring 43, the plunger 44 is caused to project out of the guide cylinder 49 until the flange 47 engages the step of the guide cylinder 49 through the resilient ring 48, the actuator 36 is also pulled up by the plunger 44, the turning spring plate 30 and movable contactor 28 are moved upward at the respective base ends by the push rod 37 of the actuator 36, and the movable contact 29 is operated to turn into contact with the lower fixed contact 26.

When the foregoing assembling and fixation of the switch assembly 12 to the housing 11 are performed with respect to a plurality set of them using the same setting jig 54, a plurality of limit switches respectively provided substantially with the same operating position at the time of the assembling, that is, all actuatable when the projecting amount of the plunger 44 out of the guide cylinder 49 is made substantially the same as retreated by an external force, can be obtained simultaneously with the assembling. Accordingly, the limit switch having substantially a constant operating position can be installed to an associated equipment without requiring any complicated adjusting work individually and, even at the time of replacing the installed switch with a new one, the limit switch which involving substantially no variation in the operating position can take the place of the old one. Since the switch assembly 12 is fixed to the housing 11 in the actually operable position, further, any possible fluctuation involved in the component members due to a projection tolerance does not affect at all the setting of the normal operating position.

The limit switch of the present invention is installed to the associated instrument by means of, for example, fixing screws screwed into a part of the instrument through the fixing holes 50 and 51. In this case, the fixing hole 14 formed in the switch body 13 of the switch assembly 12 is made to be elliptic shape or the like having the major and minor axes so that the hole 14 can be well aligned with the fixing hole 51 of the housing depending on the fixing position of the assembly 12 to the housing 11. This also allows to utilize the fixing holes 51 and 14 for the fixation of the housing 11 and switch assembly 12. If, for example, the diameter of the fixing hole 51 is made larger than the minor axis of the fixing hole 14 and a fixing member of a diameter corresponding to that of the fixing hole 51 is urged into the fixing hole 14 through such hole 51, the housing 11 and switch assembly 12 can be fixed to one another.

Further according to the present invention, the plunger 44 provided for performing the turning motion of the switch mechanism 22 as a result of the retreating of the plunger is so made as to be sufficiently movable inward, that is, for a relatively large distance so that, even an excessive pushing force is applied to the plunger 44, the force can be well absorbed. Further, the pushing force applied to the plunger 44 is effective to cause the switch mechanism 22 to be released from the normally applied resetting force to the same, so that the contact switching members of the switch mechanism 22 can be entirely prevented from being damaged by the excessive pushing force to the plunger. Yet, the moving direction of the plunger 44 and that of the actuator 36 for actuating the switch mechanism 22 are made to be identical, whereby the switch assembly 12 can be minimized in size and the limit switch can be generally made compact.

Summarizing the effects of the present invention, a limit switch of which the adjustment of the operating position can be completed simultaneously with the completion of the assembly and the operating position is made uniform for any required number of the switches at a high precision with a compact formation without requiring any incorporation of special adjusting arrangement therein can be provided. Further, the structure is so simple and compact and the production tolerance can be well absorbed so that the production workability can be improved. Also, the operating position can be made constant so well that, even if the limit switch is replaced with a new one, it will be able to be immediately used without being readjusted.

What is claimed is:

1. A limit switch comprising:

a hollow housing having an open bottom and a guide cylinder projecting upwardly from a top of said housing, a casing, electrical contact means carried by said casing, said contact means comprising at least one movable contact and at least one stationary contact, said movable contact being movable between first and second positions, wherein said movable and stationary contacts interengage in one of said first and second positions and disengage in the other of said positions, plunger means mounted on said casing in a manner forming with said casing and said contacts a unit capable of being inserted upwardly into said open bottom of said housing, with a part of said plunger means passing upwardly through and beyond said guide cylinder, said plunger means being operably connected to said movable contact to move the latter and being movable upwardly and downwardly relative to said casing and said stationary contact, said contacts being in said first position when said plunger means is in a given downward position and being in said second position when said plunger means is in an upward position, spring means for yieldably urging said plunger means upwardly, and fixing means for fixedly mounting said casing to said housing at a selected position of adjustment relative to said housing to locate said contacts in said first position when said part of said plunger means projects a given distance beyond said guide cylinder.

2. A limit switch according to claim 1, wherein said spring means is arranged to act against said plunger means and said casing.

3. A limit switch according to claim 1, wherein said plunger means includes means for positively moving said movable contact to said second position when said spring means pushes said plunger means to an upward position.

4. A limit switch according to claim 1, wherein said plunger means is arranged to travel downwardly relative to said casing beyond said given downward position of said plunger means and out of operative connection with said movable contact.

5. A limit switch according to claim 4, wherein said plunger means includes means underlying said movable contact so as to push said movable contact to said first position when said plunger means travels upwardly, said underlying means traveling downwardly out of operative connection with said movable contact when said plunger means is pushed downwardly beyond said given downward position.

6. A limit switch according to claim 5 including a secondary spring for moving said movable contact to said first position when said plunger means is in said given downward position.

7. A limit switch according to claim 1, wherein said fixing means includes an elongate slot in one of said housing and casing and a pin projecting through the other of said housing and casing and through said slot.

8. A limit switch according to claim 1, wherein said fixing means comprises a welded connection between said casing and housing.

9. A limit switch according to claim 1, wherein said plunger means comprises a plunger body and an actuator, said actuator being of generally E-shaped configuation including a pair of guide legs and a central push rod, said legs and push rod extending parallel upwardly, said plunger body including a pair of spaced lateral projections at each side, each guide leg being insertable between a pair of said projections and having a T-bar overlying said projections, said push rod being operably connected to said movable contact when said plunger means moves upwardly.

10. A limit switch according to claim 9, wherein said plunger includes a stop engageable with a stepped portion of said housing.

* * * * *